US005416450A

United States Patent [19]

Konishi

[11] Patent Number: 5,416,450

[45] Date of Patent: May 16, 1995

[54] FERRITE LOADED CONSTANT IMPEDANCE ELEMENT AND A CONSTANT PHASE CIRCUIT USING IT IN AN ULTRA-WIDE FREQUENCY RANGE

[75] Inventor: Yoshihiro Konishi, Sagamihara, Japan

[73] Assignee: Uniden Corporation, Ichikawa, Japan

[21] Appl. No.: 120,517

[22] Filed: Sep. 14, 1993

[30] Foreign Application Priority Data

| | | | |
|---|---|---|---|
| Mar. 26, 1993 | [JP] | Japan | 5-068486 |
| Mar. 26, 1993 | [JP] | Japan | 5-068487 |
| Aug. 16, 1993 | [JP] | Japan | 5-202366 |

[51] Int. Cl.[6] ..... H01P 5/00

[52] U.S. Cl. ..... 333/23; 333/160; 333/243

[58] Field of Search ..... 333/112, 118, 131, 22 R:23, 333/138–140, 160, 161, 243, 245, 246

[56] References Cited

U.S. PATENT DOCUMENTS

| | | | |
|---|---|---|---|
| 3,479,619 | 11/1969 | Ngo | 333/160 |
| 3,553,733 | 1/1971 | Buck | 333/160 X |
| 3,886,506 | 5/1975 | Lorber et al. | 333/243 |

*Primary Examiner*—Paul Gensler

*Attorney, Agent, or Firm*—Stevens, Davis, Miller & Mosher

[57] ABSTRACT

To realize an element presenting a constant impedance throughout an extremely wide frequency range and a circuit supplying a high frequency signal having a constant phase throughout the same wide frequency range, a ferrite-loaded line element, a real part of a terminal complex impedance of which is substantially constant, is provided. A partial inclination of an imaginary part of the terminal complex impedance is compensated by providing a pure reactance element, in combination therewith As a result, in an extremely wide frequency range exceeding a natural magnetical resonant frequency, a ferrite-loaded constant impedance element and a constant phase circuit comprising this constant impedance element can be attained.

14 Claims, 10 Drawing Sheets

FERRITE LOADED CONSTANT IMPEDANCE ELEMENT AND A CONSTANT PHASE CIRCUIT USING IT IN AN ULTRA-WIDE FREQUENCY RANGE

BACKGROUND OF THE INVENTION

1. Field of the Invention

The present invention relates to an ultra-wide frequency range ferrite-loaded constant impedance element, particularly, for presenting a constant terminal impedance in an extremely wide frequency range.

The present invention also relates to a constant phase difference circuit for deriving signal power, which is applied on an opening of a circuit arrangement having plural openings, for instance, a 3 dB directional coupler, from the circuit arrangement concerned with a predetermined phase difference from the signal appearing at the opening and concerned or another opening, particularly, to an ultra-wide frequency range constant phase circuit for obtaining an output signal maintaining a predetermined phase in an extremely wide frequency range.

2. Related Art Statement

In a conventional ferrite-loaded impedance element of this kind, a terminal impedance thereof is usually varied in response to a frequency variation in an operational range.

Accordingly, the conventional ferrite-loaded impedance element of this kind cannot be used for communication apparatus having extremely wide operational frequency ranges allotted for satellite communication, satellite broadcast, etc., in spite of the small size and the high efficiency thereof. Accordingly, there has been a need to develop an article having a constant impedance throughout a wide operational frequency range.

On the other hand, as for the constant phase circuit of this kind, a typical 3 dB directional coupler has been conventionally used. The directional coupler belongs to those of distributed coupling type as shown in FIG. 1A and of lumped constant type as shown in FIG. 1B, the former being provided with conjugated terminals, each consisting of ends of one fourth wave length parallel dual lines, while the latter being provided with conjugated terminals each consisting of connection points between two coils L and two capacitors C connected with both ends of the coils, so as to derive output signals having phases $\phi 2$ and $\phi 3$ which lag successively by 90 degrees behind the input signal phase $\phi 1$.

In contrast with the directional coupler thus formed of passive elements, another kind of conventional phase circuit is arranged by combining active elements as shown in FIG. 2, so as to obtain an output signal through a wide frequency range. In this phase circuit, a high frequency signal having a frequency f is applied to a frequency multiplier 2 from a signal source 1, so as to double the frequency f. The multiplied output signal of frequency 2f is divided into two branches, one of which is directly supplied to a frequency divider 3, while another of which is supplied to another frequency divider 5 through a 180 degree phase shifter 4, so as to divide the frequency 2f into one half and to derive two distributed output signals having the frequency f and the mutual phase difference of 90 degrees through filters 6 and 7 respectively.

However, all of the aforesaid conventional phase circuits have individual respective defects. Although the directional coupler can be extremely simply arranged, the amplitudes of two phase difference output signals having the phase difference $\phi 2-\phi 3=90$ degrees therebetween are further reduced, as shown in FIG. 1C, in response to the frequency difference from $-3$ dB at the respective central frequencies, which is determined by the line length of the distributed coupling type and which is an angular frequency $\omega=\sqrt{Lc}$ of the lumped constant type, so that the directional coupler cannot be employed as a wide frequency range constant phase circuit.

On the other hand, the conventional constant phase circuit formed of active elements has a complicated arrangement as shown in FIG. 2, so that the constant phase circuit of this kind is not adapted for practical use.

Consequently, the removal of these defects is a subject of the conventional constant phase circuit to be solved.

SUMMARY OF THE INVENTION

An object of the present invention is to provide an ultra-wide frequency range ferrite-loaded constant impedance element in which the aforesaid difficulty is removed and a constant terminal impedance is presented in an extremely wide frequency range.

Another object of the present invention is to provide a phase circuit having a simple arrangement in which a constant phase output signal having a substantially constant amplitude, in an extremely wide frequency range, can be obtained.

An ultra-wide frequency range ferrite-loaded constant impedance element according to the present invention is featured in that the constant impedance element is formed of a ferrite-loaded distributed line having a predetermined line length and an operational region of the constant impedance element is set to a specific frequency range among a frequency range exceeding a natural magnetical resonant frequency of ferrite, in which specific frequency range a real part of a terminal impedance presented by said ferrite-loaded distributed line is substantially constant, so as to present a constant impedance.

On the other hand, an ultra-wide frequency constant phase circuit according to the present invention is provided by utilizing a specific property of the ferrite-loaded constant impedance element, so as to obtain a high frequency output signal having substantially constant phase and amplitude in an extremely wide frequency range allotted for electronic communication through a simple structure substantially formed of passive elements only. The constant phase circuit is featured in that, on the basis of the fact that, as for the constant impedance element presenting magnetic loss based on ferrite loading, both real and imaginary parts of an impedance presented by the constant impedance element concerned are maintained substantially constant against the variation of frequency in a frequency range higher than the natural magnetic resonant frequency at which the magnetic loss becomes maximum, in a circuit arrangement provided with four openings, each two of which are conjugate pairs, where two openings in one of the conjugate pairs are terminated by the constant impedance element and a pure resistive element respectively, and, when an opening of another of the conjugate pairs is applied with a signal, two signals respectively appearing at another opening of the other of the conjugate pairs and at the opening terminated by the pure resistive element in said one of the conjugate pairs present a predetermined phase difference therebetween throughout the frequency range.

Consequently, according to the present invention, a constant impedance element and further a constant phase circuit using it in which a ferrite-loaded line element having a small size and a high efficiency is adopted can be employed for satellite communication apparatus having an operational region throughout an extremely wide frequency range.

BRIEF DESCRIPTION OF THE DRAWINGS

For the better understanding of the invention, reference is made to the accompanying drawings, in which.

DESCRIPTION OF THE PREFERRED EMBODIMENTS

Preferred embodiments of the present invention will be described in detail by referring to THE accompanying drawings hereinafter.

At the outset, an operational principle of the ultra-wide frequency range ferrite-loaded constant impedance element and the ultra-wide frequency range constant phase circuit using it according to the present invention will be described by adopting plural numerical equations.

Figure 1A:
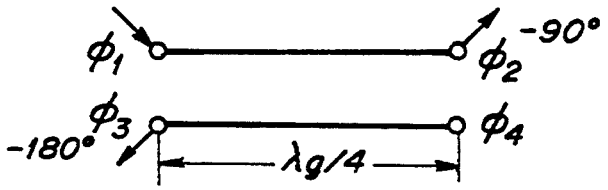
FIG. 1A PRIOR ART
FIGS. 1A, 1B and 1C are diagrams showing conventional directional couplers of distributed coupling type, conventional directional couplers of lumped constant type and an example of a frequency response property thereof, respectively.
Figure 1B:
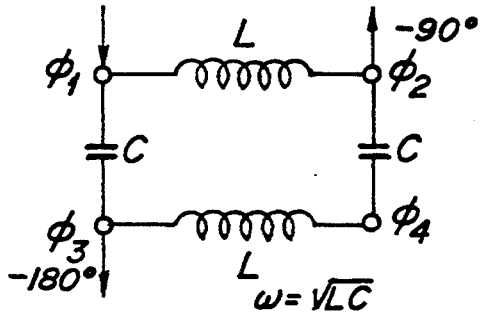
FIG. 1B PRIOR ART
Figure 1C:
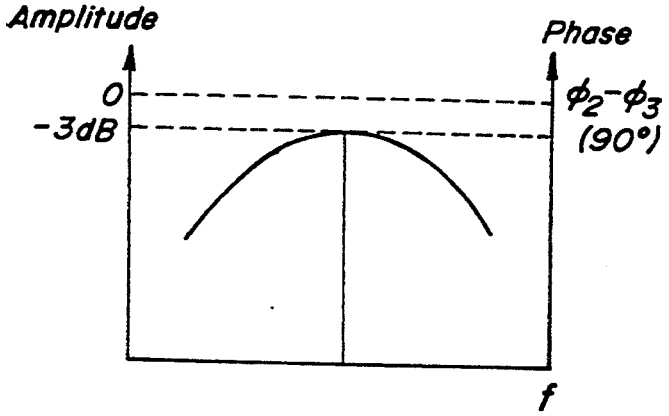
FIG. 1C PRIOR ART
Figure 2:
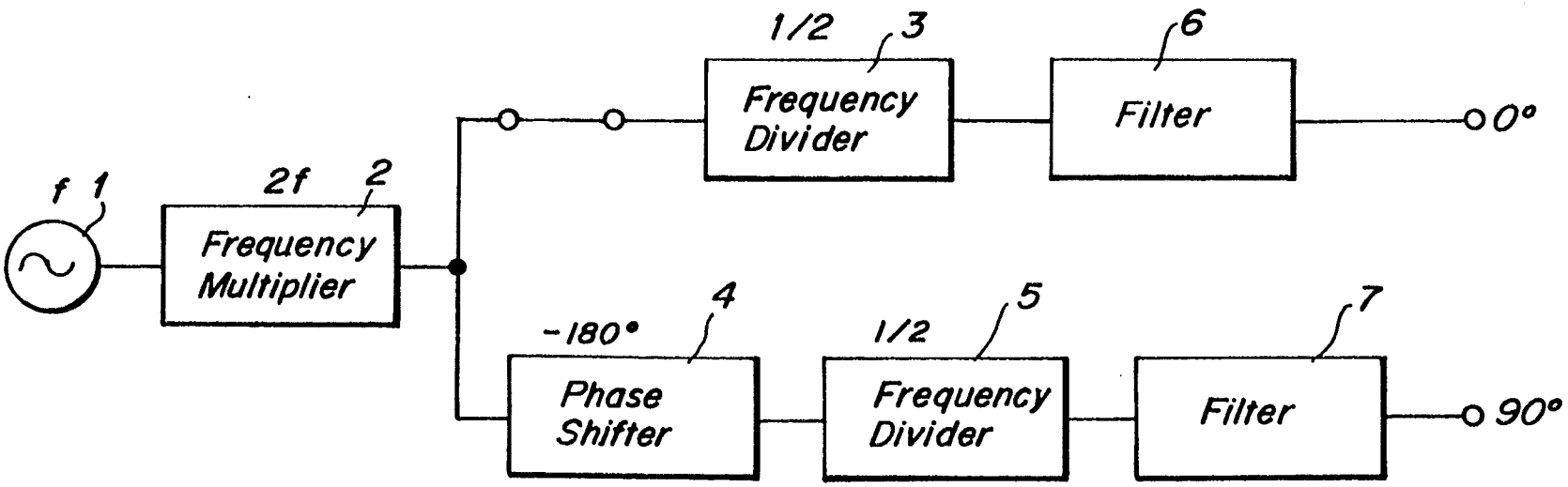
FIG. 2 PRIOR ART
FIG. 2 is a circuit diagram showing a structure of a conventional active element type phase circuit.
Figure 3:
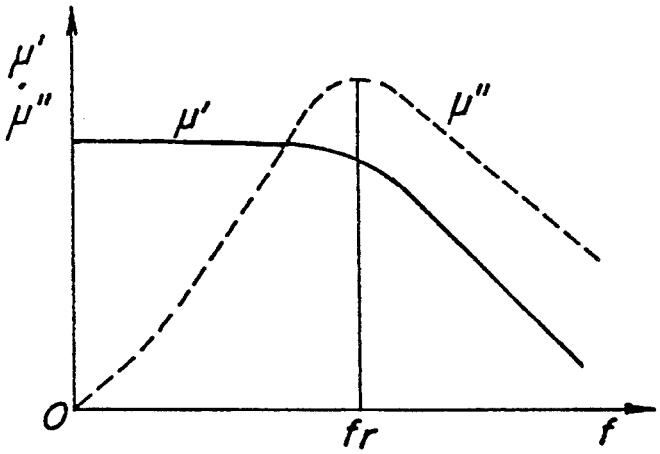
FIG. 3 is a graph showing frequency characteristics of real and imaginary parts of a complex permeability of ferrite.

The permeability $\mu$ of ferrite consists, as shown in FIG. 3, of a real part $\mu'$ corresponding to a lossless term and an imaginary part $\mu''$ corresponding to a loss term, so that the complex permeability $\dot{\mu}$ can be expressed by the following equation (1).

$$\dot{\mu}=\mu'-j\mu'' \tag{1}$$

In this connection, the so-called Kramers Kronig's relation exists between the real part $\mu'$ and the imaginary part $\mu''$ of the complex permeability.

In other words, the imaginary part $\mu''$ has a maximum value at the natural magnetical resonant frequency fr, whilst the real part $\mu'$ has a substantially constant value in a frequency range lower than this resonant frequency fr and is gradually reduced in another frequency range higher than the resonant frequency fr.

Figure 4:
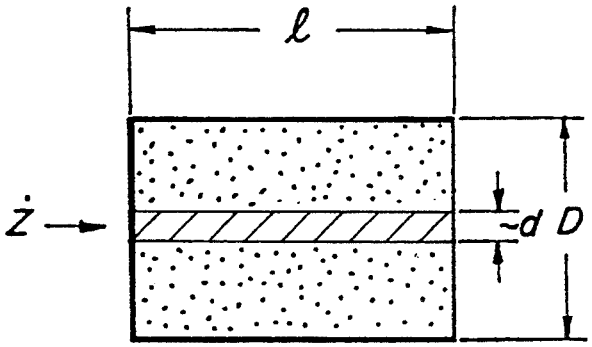
FIG. 4 is a cross-sectional view showing a structure of a ferrite-loaded coaxial line.

When it is assumed that, in a state such that ferrite is loaded onto a dielectric material portion of a coaxial line having a length l, one end of which is short-circuited, by being filled up therein as shown in FIG. 4, a terminal impedance at another end thereof is $\dot{Z}$, the following equation (2) can be obtained with regard to a dielectric constant $\epsilon$, a non-loaded line impedance $Z_0$ and a propagation constant $\gamma$.

$$\left.\begin{aligned} \dot{Z} &= \sqrt{\mu/\varepsilon}\ Z_0 \tanh \gamma \ell \\ \gamma^2 &= -\omega^2\mu\varepsilon \end{aligned}\right\} \tag{2}$$

In a case that it is assumed for the simplicity that $$\omega\sqrt{\dot{\mu}\epsilon}\ l < 1 \tag{3}$$

the following equation (4) is obtained.

$$\dot{Z}=j\omega\dot{\mu}lZ_0 \tag{4}$$

where, $Z_0$ is a characteristic impedance of a coaxial line which is not loaded with ferrite.

Accordingly, when it is assumed that $$\dot{Z}=R_f+jX_f \tag{5}$$

the following equations (6) and (7) are obtained.

$$R_f\approx\omega\mu''lZ_0 \tag{6}$$

$$X_f\approx\omega\mu'lZ_0 \tag{7}$$

In this connection, as is well-known, both the real part $\mu'$ and the imaginary part $\mu''$ can be expressed by the following equation (8) as an approximation equation.

$$\dot{\mu}(f)=1+K_r/(l+jf/f_r)+(K^2_0f_0+j\beta f)/(f^2_0-f^2+j\mu f) \tag{8}$$

whilst, in a frequency range expressed by the equation (9)

$$f \gg fr \tag{9}$$

the following equation (10) can be expressed.

$$\mu_r(f)=1+K_r/(l+jf/f_r) \tag{10}$$

In this regard, ferrite usually has the following value.

$$K_r f_r \leqq 8000 \text{ MHz}$$

Furthermore, this equation (10) becomes as follows with regard to ferrite.

$$\begin{aligned} \mu_r(f) &\simeq 1 + K_r f_r/[jf(1 - jf_r/f)] \\ &\simeq 1 + (K_r f_r/jf)(1 + jf_r/f) \\ &= 1 + K_r f_r \cdot f_r/f^2 - jK_r f_r/f \end{aligned} \tag{11}$$

So that, when this value is substituted into the equations (6) and (7), the following equations (12) and (13) can be obtained.

$$R(f) \simeq 2\pi K_r f_r l Z_0 \tag{12}$$

$$X(f) \simeq 2\pi f(l+K_r f_r \cdot f_r/f^2) l Z_0 = 2\pi l Z_0(f+K_r f_r \cdot f_r/f) \tag{13}$$

It can be understood from these equations (12) and (13) that the real part R(f) of the terminal impedance presented by the impedance element formed of ferrite-loaded coaxial line is maintained substantially at a constant value, whereas the imaginary part X(f) thereof is minimized at the frequency expressed by the following equation (14).

$$f = \sqrt{K_r} \cdot f_r \tag{14}$$

Figure 5:
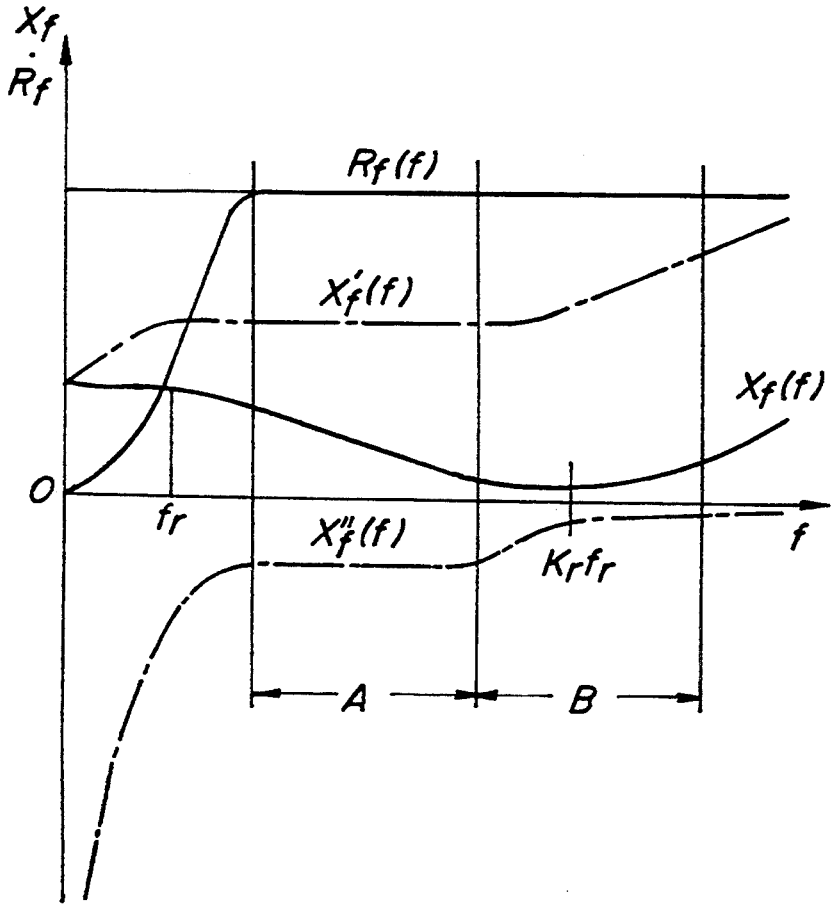
FIG. 5 is a graph showing frequency characteristics of real conductance and imaginary reactance components of a terminal impedance of the ferrite-loaded coaxial line element.

The terminal impedance of the element which comprises the ferrite-loaded coaxial line mentioned above can be expressed as shown in FIG. 5. In the frequency region B as shown in FIG. 5, both the real conductance component $R_f$ and the imaginary reactance component $X_f$ present a substantially constant value, and further the reactance component $X_f$ is minimized at the frequency $K_r f_r$. On the other hand, in the frequency region as shown in FIG. 5, although the conductance component $R_f$ presents a substantially constant value, the reactance component $X_f$ decreases in response to the increase of the frequency.

Consequently, when a terminal impedance of a series connection of the ferrite-loaded coaxial line and an element having pure reactance, which is increased in response to the increase of frequency, is denoted by Z', this terminal impedance Z' is expressed by the following equation (15).

$$\begin{aligned} \dot{Z}' &= R_f(f) + j\{X_0(f) + X_f(f)\} \\ &= R + jX \end{aligned} \tag{15}$$

where R and X are constant regardless of the frequency.

So that, as a result, a constant impedance, real and imaginary parts of which are not varied by the variation of frequency, can be realized.

In this connection, $X_f'(f)$ and $X_f''(f)$ as shown in FIG. 5 by single-dot chain lines denote reactance components obtained by connecting an inductance element and a capacitance element in series to the ferrite-loaded coaxial line, respectively.

Figure 6:
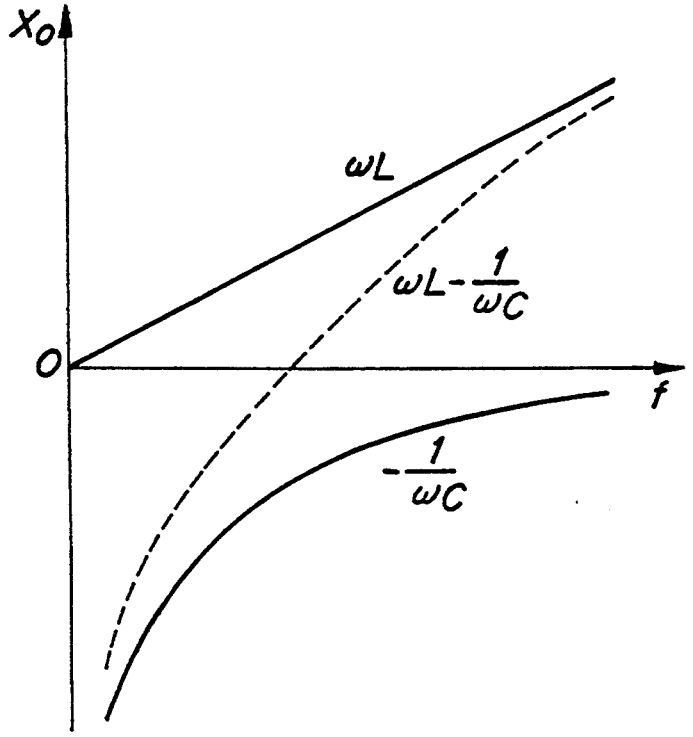
FIG. 6 is a graph showing reactance frequency characteristics presented by a pure reactance element.

When an inductance element is used for the aforesaid pure reactance element, the reactance is linearly increased in response to the increase of the frequency f (See FIG. 6), whilst, when an capacitance element is used for the aforesaid pure reactance element, the reactance is increased along a gentle curve in response to the increase of the frequency f (See FIG. 6). Accordingly, in the case that the inductance element is connected as the pure reactance element in series with the ferrite-loaded coaxial line, the imaginary reactance component $X_f'(f)$ of the terminal impedance of this series connection becomes as shown by the single-dot chain line in the region $X_0>0$ of FIG. 5 and hence can be maintained substantially at a constant positive value in the frequency range A, whilst in the case that the capacitance element is connected as the pure reactance element in series with the ferrite-loaded coaxial line, the imaginary reactance component $X_f''(f)$ of the terminal impedance of this series connection becomes as shown by the single-dot chain line in the region $X_0<0$ of FIG. 5 and hence can be maintained substantially at a constant negative value in the frequency range A.

In the above description, the terminal impedance of the ferrite-loaded coaxial line is investigated on the condition of the equation (3). However, in the case that the line length l becomes longer, the value of $\omega\sqrt{\dot{\mu}\epsilon}l$ in the equation (3) exceeds $\pi/2$ radian. In this case, the following equation (16) can be derived from the equation (2).

$$X_f<0 \tag{16}$$

Figure 7:
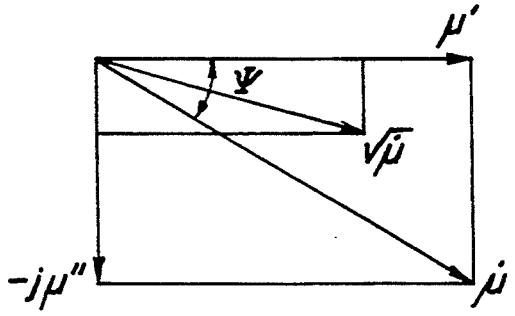
FIG. 7 is a vector diagram showing a relation between real and imaginary parts of a complex permeability of ferrite.

That is, in the case that the value of $\omega\sqrt{\dot{\mu}\epsilon}l$ exceeds $\pi/2$ radian, the condition as shown in FIG. 7 is established and hence the following equations (17) and (18) are obtained.

$$\left.\begin{aligned} \sqrt{\dot{\mu}'} &= \sqrt{\mu' - j\mu''} \\ &= \sqrt{|\dot{\mu}|}\ \{\cos(\psi/2) - j\sin(\psi/2)\} \\ &= \alpha - j\beta \end{aligned}\right\} \tag{17}$$

$$\left.\begin{aligned} \alpha &= \sqrt{|\dot{\mu}|}\ \cos(\psi/2) \\ \beta &= \sqrt{|\dot{\mu}|}\ \sin(\psi/2) \\ \psi &= \tan^{-1}(\mu''/\mu') \end{aligned}\right\} \tag{18}$$

So that, the following equations are successively obtained.

$$\begin{aligned} \tanh j\omega\sqrt{\dot{\mu}\epsilon l} &= \tanh j\omega\sqrt{\epsilon}\, l(\alpha - j\beta) \\ &= \tanh(j\omega\sqrt{\epsilon}\, l\alpha + \omega\sqrt{\epsilon}\, l\beta) \\ &= (\tanh\sqrt{\epsilon}\,\omega l\beta + j\tan\omega\sqrt{\epsilon}\, l\alpha \\ &\quad (1 + j\tanh\omega\sqrt{\epsilon}\, l\beta \cdot \tan\omega\sqrt{\epsilon}) \end{aligned}$$

$$\begin{aligned} \dot{Z} &= (\alpha - j\beta)\sqrt{\epsilon} \cdot (\tanh\omega\sqrt{\epsilon}\, l\beta + j\tan\omega\sqrt{\epsilon}\, l\alpha)/ \\ &\quad (1 + j\tanh\omega\sqrt{\epsilon}\, l\beta \cdot \tan\omega\sqrt{\epsilon}\, l\alpha) \\ &= (\alpha - j\beta)/\sqrt{\epsilon} \cdot /\Delta[\{\tanh\omega\sqrt{\epsilon}\, l\beta + \tanh\omega\sqrt{\epsilon}\, l\beta \cdot \\ &\quad (\tan\omega\sqrt{\epsilon}\, l\alpha)^2\} + j\{\tanh\omega\sqrt{\epsilon}\, l\beta)^2\tan\omega\sqrt{\epsilon}\, l\alpha + \\ &\quad \tan\omega\sqrt{\epsilon}\, l\alpha\}] \end{aligned}$$

-continued $$\Delta = 1 + (\tanh \omega \sqrt{\epsilon}\, l\beta \cdot \tan \omega \sqrt{\epsilon}\, l\alpha)^2$$

So that, the following equations (19) and (20) are obtained.

$$\begin{aligned} X_f &= 1/(\sqrt{\epsilon} \cdot \Delta)\,[\alpha\,\{(\tanh \omega \sqrt{\epsilon}\, l\beta)^2 \tan \omega \sqrt{\epsilon}\, l\alpha + \tan \omega \sqrt{\epsilon}\, l\alpha\} - \beta[(\tanh \omega \sqrt{\epsilon}\, l\beta + \tanh \omega \sqrt{\epsilon}\, l\beta \cdot (\tan \omega \sqrt{\epsilon}\, l\alpha)^2\}] \\ &= 1/(\sqrt{\epsilon} \cdot \Delta)\,\{\alpha \tan \omega \sqrt{\epsilon}\, l\alpha(1 + \tanh^2 \omega \sqrt{\epsilon}\, l\beta) - \beta \tanh \omega \sqrt{\epsilon}\, l\beta(1 + \tan^2 \omega \sqrt{\epsilon}\, l\beta)\} \\ &= 1/(\sqrt{\epsilon} \cdot \Delta) \cdot \tanh \omega \sqrt{\epsilon}\, l\beta(2\alpha \tan \omega \sqrt{\epsilon}\, l\alpha)/(\tanh^2 \omega \sqrt{\epsilon}\, l\beta - \beta/(\cos^2 \omega \sqrt{\epsilon}\, l\beta)\} \\ &= 1/\sqrt{\epsilon} \cdot \Delta) \cdot \{2\alpha \tan \omega \sqrt{\epsilon}\, l\alpha - (\beta \tanh \omega \sqrt{\epsilon}\, l\beta)/(\cos^2 \omega \sqrt{\epsilon}\, l\beta)\} \end{aligned} \tag{19}$$

$$\begin{aligned} R_f &= 1/(\sqrt{\epsilon} \cdot \Delta)\,\{\alpha \tanh \omega \sqrt{\epsilon}\, l\beta(1 + \tan^2 \omega \sqrt{\epsilon}\, l\alpha) + \beta \tan \omega \sqrt{\epsilon}\, l\beta(1 + \tan^2 \omega \sqrt{\epsilon}\, l\beta)\} \\ &= 1/(\sqrt{\epsilon} \cdot \Delta) \cdot \tanh \omega \sqrt{\epsilon}\, l\beta\,\{\alpha/(\cos^2 \omega \sqrt{\epsilon}\, l\alpha) + (2\beta \tan \omega \sqrt{\epsilon}\, l\beta/\tanh^2 \omega \sqrt{\epsilon}\, l\beta)\} \\ &= 1/(\sqrt{\epsilon} \cdot \Delta) \cdot (2\beta \tan \omega \sqrt{\epsilon}\, l\beta + (\alpha \tanh \omega \sqrt{\epsilon}\, l\beta)/(\cos^2 \omega \sqrt{\epsilon}\, l\alpha)\} \end{aligned} \tag{20}$$

In this regard, because tanh $X>0$, $X>0$, on the basis of the equation (19), when the line length l of the ferrite-loaded coaxial line is increased, the imaginary reactance component X takes a negative value.

For example, the ferrite-loaded coaxial line element as shown in FIG. 4 is formed by inserting a central conductor of a diameter 0.8 mm into a central hole of a ferrite cylinder having sizes of $l=6$ mm, $D=3.5$ mm and $d=1$ mm and an initial permeability 1000 in a frequency range $f \ll fr$ and by short-circuiting one end thereof with an earthed (grounded) surrounding surface.

Figure 8:
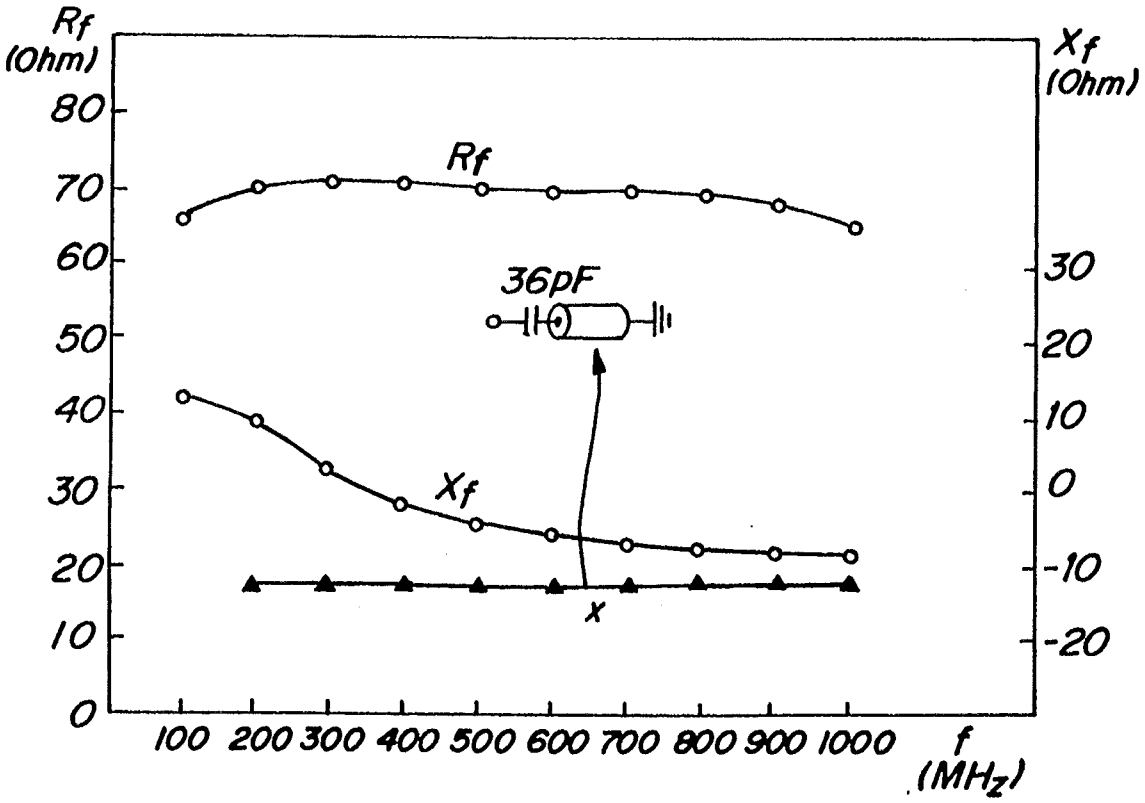
FIG. 8 is a graph showing measured results of a terminal impedance frequency characteristics of a ferrite loaded line element.

The measured frequency characteristics of the real conductance component $R_f$ and the imaginary reactance component $X_f$ of the terminal impedance of the thus formed ferrite-loaded coaxial line element are as shown in FIG. 8. In these frequency characteristics, as a result that the line length l is long in comparison with the coaxial diameters D, d, the reactance $X_f$ takes a negative value $X_f<0$ in a frequency range substantially higher than 300 MHz. So that, when the line length l is halved to 3 mm, it is natural from the above that the reactance $X_f$ takes the negative value $X_f<0$ in a frequency range higher than 720 MHz.

The reactance component $X_f$ of the terminal impedance of the ferrite-loaded coaxial line element is, as mentioned above, decreased along a right hand downward curve, so that it is enough as described above that the pure reactance element is inserted in series therewith.

In other words, the reactance component X of the terminal impedance Z' of the aforesaid series connection in which the ferrite-loaded coaxial line element is connected in series with a capacitor having a capacitance 36 pF becomes $$12\Omega < X < 12.5\Omega$$

in a frequency range 200 MHz to 800 MHz as written in FIG. 8, whilst the conductance $R_f$ thereof becomes $$70\Omega < R_f < 70.5\Omega$$

in the same frequency range, so that the terminal impedance $\dot{Z}'$ of the ferrite-loaded coaxial line element connected in series with the pure reactance element for compensating the reactance component has substantially a constant value throughout the frequency range between 200 MHz and 800 MHz, so as to realize a constant impedance.

In this regard, as for the pure reactance element for compensating the imaginary reactance component $X_f$ of the terminal impedance Z of the ferrite-loaded coaxial line, the same effect as described above for compensating the reactance component can be obtained by being connected in series with the other end, that is, the open end of the coaxial line, one end of which is short-circuited, as well as by earthing (grounding) the other end of the pure reactance element, one end of which is connected in series with the end thereof to be short-circuited.

Consequently, according to the present invention, a special effect such that the ferrite-loaded coaxial line element having a small size and high efficiency can be employed in a wide field of use as a constant impedance element presenting substantially a constant terminal impedance in an extremely wide frequency range can be attained. Further, in certain embodiments, the impedance of the element is adjustable in response to application of a direct current magnetic field, having adjustable intensity, upon the ferrite loading of the distributed line.

On the other hand, the ultra-wide frequency range constant phase circuit according to the present invention is provided by adopting the aforesaid ferrite-loaded coaxial line element for deriving a high frequency signal component presenting a desired constant phase difference from that of an input high frequency signal. The circuit arrangement may include a ferrite-loaded 3 dB directional coupler. Examples of the circuit arrangement thereof will be described hereinafter.

Figure 9:
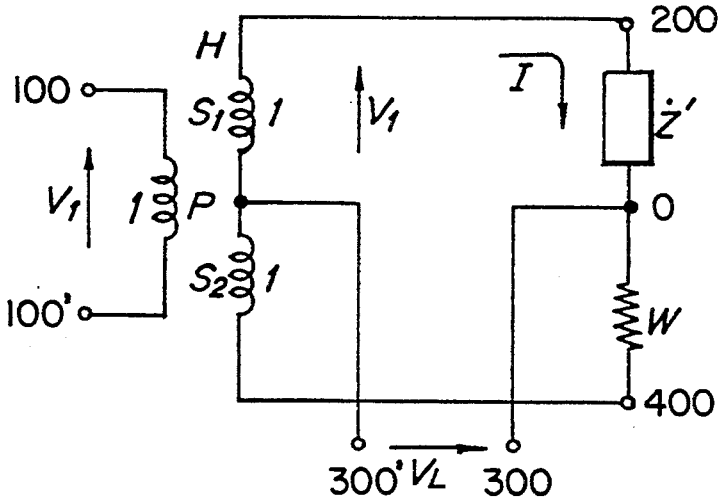
FIG. 9 is a circuit diagram showing an example of an ultra-wide frequency range constant phase circuit according to the present invention.

In a circuit as shown in FIG. 9 by adopting a hybrid coil which is formed by winding a primary coil P and secondary coils S1, S2 closely in parallel with each other, a ferrite-loaded coaxial line element having a terminal impedance Z', a partial inclination of reactance component frequency characteristic of which is compensated, is connected between openings 100 and 0 of the circuit concerned, while a pure resistive element W is connected between openings 100 and 0 thereof. An output signal voltage $V_l$, which appears between openings 300 and 300', when a signal voltage $V_1$ is applied between openings 100 and 100', can be obtained as follows.

$$V_l = V_1 - I\dot{Z}' = IW - V_1 \tag{21}$$

So that, $I = 2V_1/(\dot{Z}' + W)$ (22)

When this equation (22) is substituted into the equation (21), the following equation (23) is obtained.

$$V_l = V_1 - 2\dot{Z}/(\dot{Z} + W) \cdot V_1 = V_1 (W - \dot{Z})/(\dot{Z} + W) \quad (23)$$

When the equation (15) is substituted into this equation (23), the following equation (24) is obtained.

$$V_l = (W - R - jX)/(W + R + jX) \cdot V_1 \quad (24)$$

Figure 10:
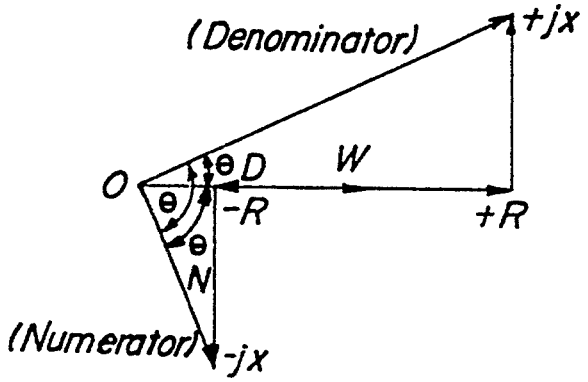
FIG. 10 is a vector diagram showing output signal components in the constant phase circuit of the present invention.

The relation between vectors expressed by this equation (24) can be indicated as shown in FIG. 10. A phase difference angle $\theta$ which is sustained between a composite vector expressed by the denominator thereof and another composite vector expressed by the numerator can be expressed by the following equation (25).

$$\theta = \tan^{-1}\{X/(W-R)\} + \tan^{-1}\{X/(W+R)\}\theta_n + \theta_D \quad (25)$$

Accordingly, the phase difference angle $\theta$ can be set at $\theta = \pi/2$ radian or at another desired angle in the vicinity thereof by selecting the terminal impedance of the ferrite-loaded coaxial line element such that the following equation (26) can be attained.

$$W > R \quad (26)$$

Figure 11:
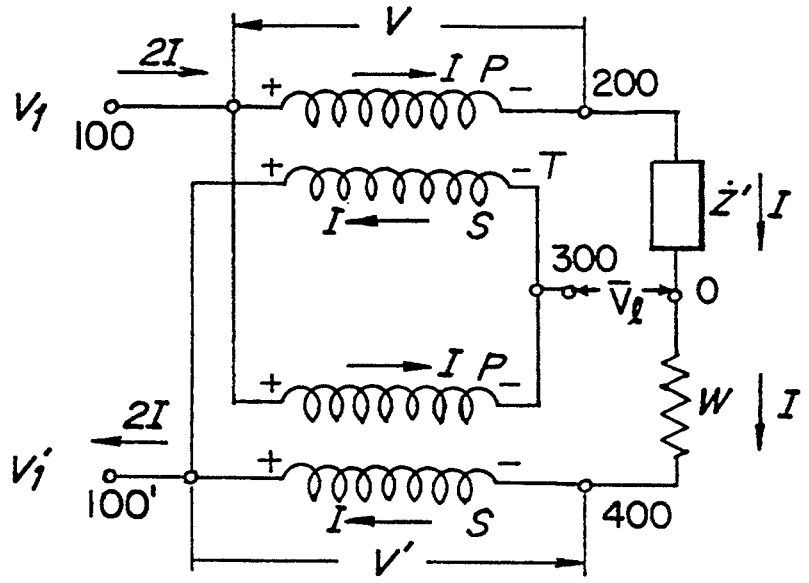
FIG. 11 is a circuit diagram showing an example of the ultra-wide frequency range constant phase circuit employing two winding transformers.

On the other hand, in a circuit arranged as shown in FIG. 11 by adopting dual winding transformers T and T' with a winding ratio 1:1, an output signal voltage $V_l$ appearing between openings 300 and 0, when a ferrite-loaded coaxial line element having a terminal impedance Z', a partial inclination of reactance component frequency characteristic of which is compensated, is connected between openings 200 and 0, while a pure resistive element W is connected between openings 400 and 0 and further signal voltages V1 and $V_1'$ are applied upon openings 100 and 100 ' respectively, can be obtained as follows.

When currents flowing through windings P and S of the transformers T and T' are denoted by I, while voltages applied upon those transformers T and T' are denoted by V and V' respectively, the following equation (27) can be obtained.

$$\left.\begin{aligned} V_1 &= V + \dot{Z}I \;,\; V_1 = V' + V_l \\ V_1' &= V_l + V' \;,\; V_1' = V' - VI \end{aligned}\right\} \quad (27)$$

So that, when both members of upper and lower equations on the left side and the right side of the equation (27) are subtracted from each other, the following equation (28) is obtained.

$$\left.\begin{aligned} V_1 - V' &= \dot{Z}I - V_l \\ V_1 - V_1' &= V_l + WI \end{aligned}\right\} \quad (28)$$

On the other hand, when those members are added to each other, the following equations are successively obtained.

$$2(V_1 - V_1') = (\dot{Z} + W)I \quad V_1 - V_1' = (\dot{Z} + W)/2 \cdot I \quad (29)$$

When this equation (29) is substituted into both of upper and lower sides of the equation (28), the following equation is obtained.

$$V_1 = (\dot{Z} + W)/2 \cdot I - WI = (\dot{Z} + W)/2 \cdot I$$

Furthermore, when the above equation is substituted into the equation (29), the following equation (30) is obtained.

$$V_1 = 1/2 \cdot \{2(V_1 - V_1')(\dot{Z} - W)\}/(\dot{Z} + W) = (\dot{Z} - W)/(\dot{Z} + W) \cdot (V_1 - V_1') \quad (30)$$

This equation (30) is arranged in the same form as equation (23) in the circuit arrangement as shown in FIG. 9, so that, the same vector relation as shown in FIG. 10 can be obtained in the circuit arrangement as shown in FIG. 11 also and hence it is possible to set a desired phase difference angle as for the output signal similarly as mentioned before.

Figure 12:
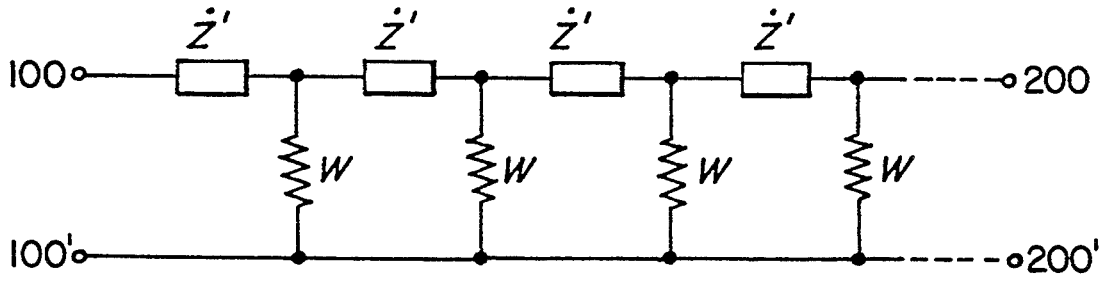
FIG. 12 is a circuit diagram showing an example of the ultra-wide frequency range constant phase circuit comprising ferrite-loaded line elements and pure resistive elements.

Furthermore, it is also possible to realize an ultra-wide frequency range constant phase circuit for the object of the present invention by directly combining the ferrite-loaded coaxial line element having the compensated reactance frequency property and the pure resistive element with each other as shown in FIG. 12. In other words, as shown in this drawing, the ferrite-loaded coaxial line element in series, the partial inclination of reactance component frequency characteristic of which is compensated by connecting the pure reactance element in series thereto, and the pure resistive element in parallel are successively, alternately and repeatedly connected between input and output openings, so as to successively accumulate signal phases obtained at successive connection points between the desired constant impedance Z' in the ultra-wide frequency range, which is presented by the ferrite-loaded coaxial line element, and the pure resistance W.

As a result, any desired constant phase, for instance, of $\pi/2$ radian, can be realized throughout an extremely wide frequency range.

In this regard, it has been described as for the ferrite-loaded coaxial line element (i.e., the ferrite-beads-loaded coil which is formed by inserting a conductor through a central hole of a ferrite (cylinder), that both real conductance $R_f = \omega\mu'' L_0$ and imaginary reactance $X_f = \omega\mu' L_0$ of complex impedance Z become substantially constant regardless of the frequency in a wide frequency range exceeding the natural magnetical resonant frequency fr at which the imaginary permeability $\mu''$ is maximized. However, in practice, these values slightly deviate from the constant. So that the reflection factor I' based on the element concerned is somewhat varied in response to the variation of frequency.

For example, in a measured result of the terminal impedance of the ferrite-loaded coaxial line element formed of NiZn ferrite cylinder having an initial permeability of about 1000 in a frequency range $f \ll fr$, both conductance $R_f$ and reactance $X_f$ are slightly varied in the ranges $R_f = 37$ to $42\Omega$ and $X_f = 6$ to $9\Omega$ in response to the frequency variation 50 MHz to 1,000 MHz.

As for thus varied terminal impedance Z of the ferrite loaded coaxial line element, for instance, a portion of the pure resistive element W connected with the opening 400 in the circuit arrangement as shown in FIG. 9 is made adjustable by employing, for example, a pin diode, the resistance of which is manually or automatically varied, so as to maintain the phase difference between output signals at a desired value, for instance, at 90 degrees. In the case, for example, that it is desired that the phase difference between output signals be automatically set, for instance, to 90 degrees, a multiplication output of output signals at the mutual phase difference 90 degrees is obtained, for instance, by applying a synchronous detection upon one of those output signals with a local oscillation output having a predetermined phase difference of 90 degrees from the other of those output signals, and hence the aforesaid adjustable resistance is automatically varied, so as to maintain the aforesaid multiplication output at zero.

Figure 13A:
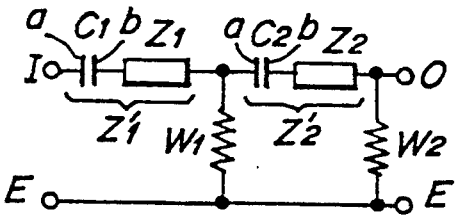
FIGS. 13A 13B and 13C are diagrams showing an equivalent circuit, an assembled perspective view and a disassembled perspective view of an integrated partial structure of the constant phase circuit shown in FIG. 12; and FIGS. **14*a* and 14B** are circuit diagrams showing ultra-wide frequency range 90 degree phase shifters employing constant impedance elements together with a field effect transistor amplifier and an operational transistor amplifier, respectively.
Figure 13B:
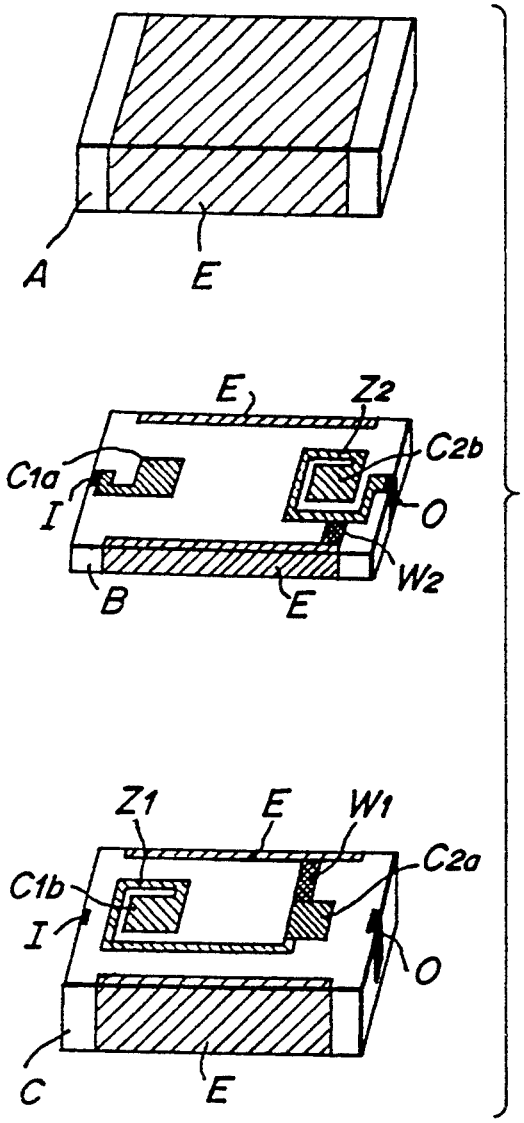
Figure 13C:
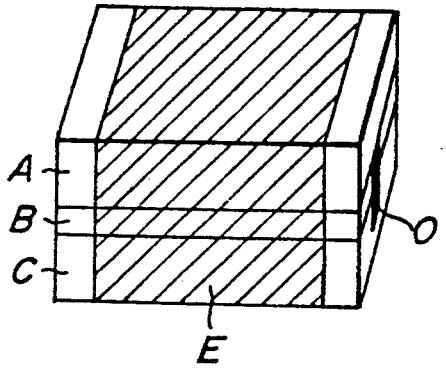

Next, an example of a specific structure of the constant phase circuit according to the present invention, which is arranged so as to be readily made of ceramics, is shown in FIGS. 13A–C with regard to a 2 stage cascade connection of the basic arrangement as shown in FIG. 12. FIG. 13A shows an equivalent circuit of only two stages of the multistage circuit as shown in FIG. 12 which two stages are made of ceramics by forming the ferrite-loaded element Z′ of the series connection of a coupling capacitor C and a ferrite-loaded coil Z.

FIG. 13B shows a three layer ceramics circuit arranged by embodying the equivalent circuit, shown in FIG. 13A in a disassembled state, whereas FIG. 13C shows an external view of the three stage ceramics circuit as shown in FIG. 13B in a stacked state. This ceramics circuit is provided with an input terminal I and an output terminal O in front and rear sides thereof respectively and is shielded by being surrounded with earthed (grounded) conductor films E.

The lower layer of the three layer structure as shown in FIG. 13B is provided by integrating the first half of the equivalent circuit as shown in FIG. 13A, that is, from the latter half $C_{1b}$ of the coupling capacitor $C_1$ in the first stage to the first half $C_{2a}$ of the coupling capacitor $C_2$ in the second stage on an upper face of a thick ferrite substrate C.

The middle layer of the three layer structure is provided by integrating the latter half of the equivalent circuit, that is, the first half $C_{1a}$ of the coupling capacitor $C_1$ in the first stage and the subsequence from the latter half $C_{2b}$ of the coupling capacitor $C_2$ in the second stage on an upper face of a thin ferrite substrate B.

The upper layer of the three layer structure only comprises a thick ferrite substrate A.

In this connection, the ferrite substrates A, B and C of each layers are individually covered by earthed conductor films E, which are separated from each other, whereas they are contacted with each other in the stacked state.

The integration circuit of each layer comprises one half of a coupling capacitor C connected with a ferrite-loaded coil Z, one half of another coupling capacitor C, a pure resistive element W and input and output terminals I and O. So that, when those ferrite substrates of each layers are stacked with each other, capacitor terminal conductor films a and b are faced with each other through the thin ferrite substrate B, so as to form a coupling capacitor C.

To provide the multistage structure shown in FIG. 12 with thus arranged ceramics circuits, it is enough to arrange plural ceramics blocks as shown in FIG. 13C in cascade fashion and to make conductor films of input and output terminals I and O provided therebetween contact with each other.

Otherwise, it is enough also to stack plural ceramics blocks as shown in FIG. 13C, so as to be successively connected with each other through through-holes provided therebetween.

In this connection, to prevent stray coupling between capacitor terminal conductor films belonging to adjacent different blocks in thus stacked ceramics blocks as shown in FIG. 13C, thick ferrite substrates are provided for the upper and the lower layers.

The constant phase circuit of the present invention, which is provided by employing a hybrid coil or wire-wound transformer shown in FIG. 9 or in FIG. 11, invariably has at least 10 db signal attenuation, so that it is necessary to subordinate a transistor amplifier for compensating the signal attenuation to this constant phase circuit. As a result, the constant phase circuit of the present invention can be provided by ceasing use of the hybrid coil or the wire-wound transformer shown in FIG. 9 or FIG. 11, and by using a transistor amplifier or a transistor operational amplifier together with the ferrite-loaded coaxial line element Z′ and the pure resistive element W, so as to realize a circuit arrangement suited for the integration and hence mass production.

Examples of an ultra-wide frequency range 90 degree phase shifter according to the present invention which are arranged by employing a transistor amplifier together with the constant impedance element $R_f+jX_f$ as described above are shown in FIGS. 14A and 14B.

Figure 14A:
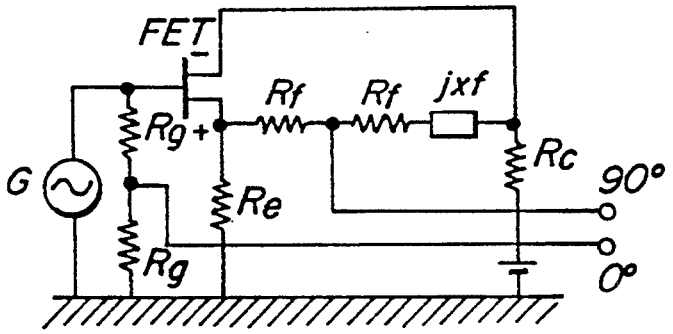

In FIG. 14A, a signal derived from a signal source G is supplied to a gate of a field effect transistor amplifier FET, and a constant phase output signal having 90 degree phase difference from a midpoint of input circuit resistors Rg is derived from an interconnection point of a cascade connection of a constant impedance element $R_f+jX_f$ and a pure resistive element $R_f$ which are provided in series between a source and a drain of the field effect transistor amplifier FET.

Figure 14B:
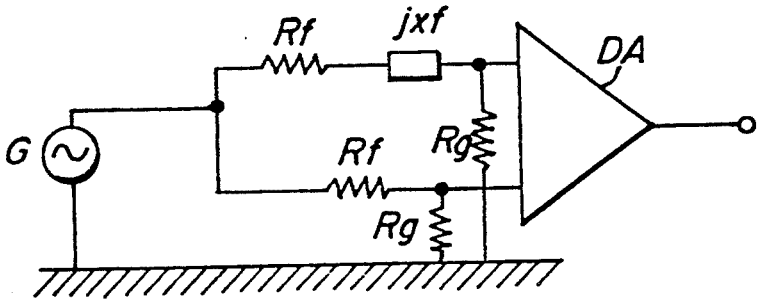

On the other hand, in FIG. 14B, a signal derived from a signal source G is supplied to an interconnection point of a cascade connection of a constant impedance element $R_f+jX_f$ and a pure resistive element $R_f$ and output signals derived from both ends of the cascade connection are supplied to a transistor operational amplifier DA which is operated as a differential amplifier, so as to derive a constant phase output signal having 90 degree phase difference therefrom as a phase difference between both end output signals of the cascade connection.

As is apparent from the above description, according to the present invention, a particularly evident effect such that an ultra-wide frequency range constant phase circuit can be steadily realized can be attained by combining a ferrite-loaded coaxial line element, which presents a constant terminal impedance throughout an extremely wide frequency range exceeding a natural magnetical resonant frequency of ferrite, and a pure resistive element.

What is claimed is:

1. An ultra-wide frequency range constant impedance element comprising:

a ferrite-loaded distributed line having a predetermined length, and a terminal impedance comprising a real part and an imaginary part, said ferrite having a natural magnetic resonant frequency of $f_r$, wherein throughout a predetermined frequency range including frequencies greater than $f_r$ (i) the real part of said terminal impedance remains substantially constant and (ii) the imaginary part of the terminal impedance varies; and a reactance element having a first end connected in series with a first end of said ferrite-loaded distributed line and one of (i) a second end of said reactance element and (ii) a second end of said ferrite-loaded distributed line being grounded, said reactance element having a predetermined reactance value so as to compensate for the variation of the imaginary part of the terminal impedance such that an impedance of said ultra-wide frequency range constant impedance element remains substantially constant throughout said predetermined frequency range.

2. An ultra-wide frequency range constant impedance element as claimed in claim 1, wherein said reactance element comprises at least one of an inductance element and a capacitance element.

3. An ultra-wide frequency range constant impedance element as claimed in claim 2, wherein said impedance of said ultra-wide frequency range constant impedance element is finely adjustable in response to application of a direct current magnetic field having adjustable intensity upon the ferrite loading of said distributed line.

4. An ultra-wide frequency range constant impedance element as claimed in claim 1, wherein said impedance of said ultra-wide frequency range constant impedance element is finely adjustable in response to application of a direct current magnetic field having adjustable intensity upon the ferrite loading of said distributed line.

5. An ultra-wide frequency range constant phase apparatus as claimed in claim 1, wherein said circuit comprises a ferrite-loaded 3 dB directional coupler.

6. An ultra-wide frequency range constant phase apparatus as claimed in claim 5, wherein said resistive element comprises an automatically adjustable part for varying a resistance value of said resistive element, said adjustable part being manually or electronically controlled.

7. An ultra-wide frequency range constant phase apparatus as claimed in claim 6, wherein said resistance value of said pure resistive element is controlled in response to a mutual multiplication product of said input signal and said resultant signal so as to maintain said phase difference therebetween constant.

8. An ultra-wide frequency range constant phase apparatus comprising:

an ultra-wide frequency range constant impedance element comprising a ferrite-loaded distributed line having a predetermined length, and a terminal impedance comprising a real part and an imaginary part, said ferrite having a natural magnetic resonant frequency of $f_r$ at which magnetic loss is maximized, wherein throughout a predetermined frequency range including frequencies greater than $f_r$ (a) the real part of said terminal impedance remains substantially constant and (b) the imaginary part of the terminal impedance varies, said ultra-wide frequency range constant impedance element further comprising a reactance element having a first end connected in series with a first end of said ferrite-loaded distributed line, said reactance element having a predetermined reactance value so as to compensate for the variation of the imaginary part of the terminal impedance such that an impedance of said ultra-wide frequency range constant impedance element remains substantially constant throughout said predetermined frequency range;

a resistive element having a first end connected to a first end of said ultra-wide frequency range constant impedance element; and four ports arranged in two conjugate pairs of ports, a first port of a first one of said conjugate pairs of ports being connected to a second end of said ultra-wide frequency range constant impedance element, a second port of said first one of said conjugate pairs of ports being connected to a second end of said resistive element, and a first port of a second one of said conjugate pairs of ports being connected to a connection point between said first end of said resistive element and said first end of said ultra-wide frequency range constant impedance element, wherein when an input signal is applied across said first one of said conjugate pairs of ports, a resultant signal presented across said second one of said conjugate pairs of ports has a predetermined phase difference from said input signal throughout said predetermined frequency range.

9. An ultra-wide frequency range constant phase apparatus as claimed in claim 8, wherein said resistive element comprises an automatically adjustable part for varying a resistance value of said resistive element, said adjustable part being manually or electronically controlled.

10. An ultra-wide frequency range constant phase apparatus as claimed in claim 9, wherein said resistance value of said pure resistive element is controlled in response to a mutual multiplication product of said input signal and said resultant signal so as to maintain said phase difference therebetween constant.

11. An ultra-wide frequency range constant phase apparatus as claimed in claim 8, further comprising at least one additional constant impedance element, wherein the ultra-wide frequency range constant impedance element and said at least one additional constant impedance element are connected in series and the resistive element is connected in parallel therebetween so as to provide a multistage circuit arrangement for successively accumulating signal phases obtained at successive connection points between the at least one additional constant impedance element and the resistive element.

12. An ultra-wide frequency range constant phase apparatus as claimed in claim 11, wherein said reactance element comprises a capacitor and said circuit is divided into a plurality of circuit sections at each capacitor and each of said circuit sections comprises one half of a pair of capacitor terminal conductor films respectively deposited on a ferrite substrate so as to provide an integrated basic circuit block through said capacitors formed on the conductor films facing each other through the ferrite substrate when said ferrite substrates are stacked.

13. An ultra-wide frequency range constant phase apparatus as claimed in claim 12, wherein a plurality of the integrated circuit blocks are arranged in cascade or stacked and are successively connected with each other through input and output openings contacted with each other or through through-holes provided therebetween.

14. An ultra-wide frequency range constant phase apparatus as claimed in claim 8, wherein said circuit comprises either one a field effect transistor amplifier and a transistor operational amplifier.

* * * * *